US005277272A

United States Patent [19]

Williams et al.

[11] Patent Number: 5,277,272

[45] Date of Patent: Jan. 11, 1994

[54] MANHOLE LADDER

[75] Inventors: Craig B. Williams, Fayetteville; Joseph H. Montgomery, Brooks, both of Ga.

[73] Assignee: M.A. Industries, Inc., Ga.

[21] Appl. No.: 25,127

[22] Filed: Mar. 2, 1993

[51] Int. Cl.[5] ..... E06C 9/04

[52] U.S. Cl. ..... 182/93; 182/194; 182/206; 182/46

[58] Field of Search ..... 182/90, 206, 194, 228, 182/46, 150, 93

[56] References Cited

U.S. PATENT DOCUMENTS

| | | | |
|---|---|---|---|
| D. 176,238 | 11/1955 | Wallace | 182/194 |
| 247,416 | 9/1881 | Row | 182/194 |
| 1,944,384 | 1/1934 | West | 182/90 |
| 4,548,294 | 10/1985 | Ruda et al. | 182/206 |
| 4,834,216 | 5/1989 | Wallick, Jr. et al. | 182/46 X |

*Primary Examiner*—Alvin C. Chin-Shue
*Attorney, Agent, or Firm*—Patrick F. Henry

[57] ABSTRACT

A non-metallic ladder for use in a manhole in which permanent manhole steps have been installed and spaced relation from the top of the manhole to a position above the bottom and there being a pair of spaced side members on said ladder connected transversely by spaced steps to form corners at the top in which there are spaces to fit over a respective side members on the step. The spaces may be in the shape of a rectangular cross-section or other configuration. The ladder is "hung" from the step to resist dislodgment therefrom. There may be provided a wall bumper member at the bottom of the ladder to engage the inside wall of the manhole.

7 Claims, 3 Drawing Sheets

MANHOLE LADDER

BACKGROUND OF THE INVENTION

1. Field of the Invention

Ladders for use in manholes such as molded plastic (e.g. high density polyethylene) for use in manhole construction.

2. Description of Prior Procedures

The prior ladders are constructed from metal and use "shepherd books" hanging from the bottom step of the bottom riser section (riser section immediately above the manhole base) by hanging the ladder on the rung of the manhole step which places a hazard in the climber's way as well as reducing the space needed by the climber. Metallic ladders which are constructed from galvanized steel, are subject to rust in the manhole sewer environment; whereas the present ladder may be constructed from non-metallic materials, such as being molded from high density polyethylene (HDPE). Also, in the metallic ladder construction the contractors often cut the ladder verticals in order to shorten the ladder if it s too long, which damages a galvanized (i.e. rust resistant) coating thereby increasing the risk of corrosion and/or breaks into the coating or covering of the metal thereby exposing the metal to rapid corrosion. The present non-metallic ladder is not subject to corrosion, especially if cut to shorten the ladder or otherwise. In addition, the present ladder does not interfere with the path of the climber, nor does it interfere with the use of the ladder rung because the present ladder is placed on the leg of the step thereby increasing the load bearing capability of the step and the ladder as well. Where the prior "shepherd hooks" bang from the rung, the present ladder snaps and locks into place at an attachment point which may be shaped and contoured to fit securely on the step legs thereby reducing the possibility of the ladder being dislodged Therefore, almost a full tread width of the step is usable and available without obstacles which would endanger the climber. The present ladder attachment method provides for much higher degree of worker safety and security realizing that there's always danger that a workman will slip and fall to the bottom of the manhole.

Other and further objects and advantages of the present ladder will become apparent upon reading the ensuing specification in conjunction with the drawings.

SUMMARY OF THE INVENTION

A ladder, which may be non-metallic such as molded from plastic, for example high density polyethylene (HDPE), provides opposed spaces which may have grooves at the top shaped (e.g. square) to fit onto the respective leg members of the step of a manhole thereby reducing the moment arm which increases the load bearing capability of the attachment step and the ladder. The present ladder may be molded in one piece employing side members and spaced step members with treads which step members are re-enforced by diagonal braces. The top of the ladder is a closed configuration which provides the spaces (e.g. grooves) on each side which fit onto the side leg members of a step which is already installed in the manhole.

Figure 1:
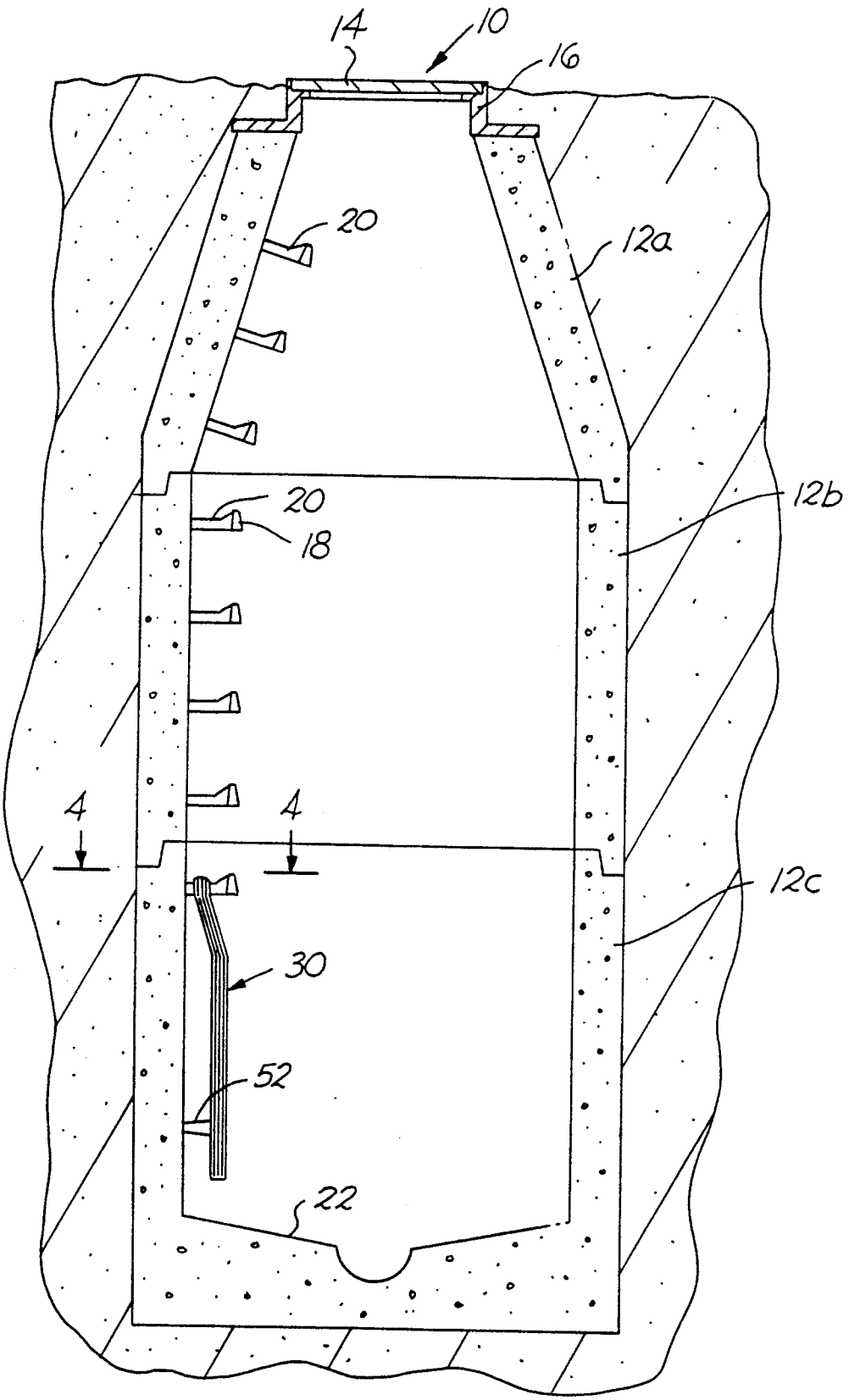
FIG. 1 is a substantially vertical cross-sectional view of a typical concrete manhole having a series of vertically spaced manhole steps which have been installed in the interior wall of the manhole, and showing the present unitary ladder installed on the lower most step and hanging therefrom.

Referring initially to FIG. 1 and thence to other figures of the drawings, a typical concrete manhole 10 is constructed from a series of manhole sections 12(*a*), 12(*b*) and 12(*c*) which may be interlocking sections made from concrete. The manhole construction which by itself does not form a part of this invention. Manhole 10 is subterranean and is located in a hole below the ground 14. The entry to the manhole 10 is covered by a heavy manhole cover 14 moveably fitted into a manhole frame 16 having suitable flanges to bold the cover 14 in place. Therefore, manhole 10 may be entered from the ground (such as street level) by removing the cover 14.

A series of manhole steps 18 have been installed permanently in one wall of the inside of the manhole by known methods. For example, step 18 could be of the threaded, tapered type, which is shown in U.S. Pat. No. 4,100,997. Steps 18 each has respective side leg members 20 and are installed into the concrete at suitable intervals from adjacent the top of the manhole 10 to near the bottom, but the lowermost step 18 is not located at the bottom 22 of the manhole, and therefore there is normally a space below bottom step 18 which makes it inconvenient and dangerous for workmen to reach the bottom 22. The present ladder 30 provides extra steps to reach the bottom of the manhole 22.

Figure 3:
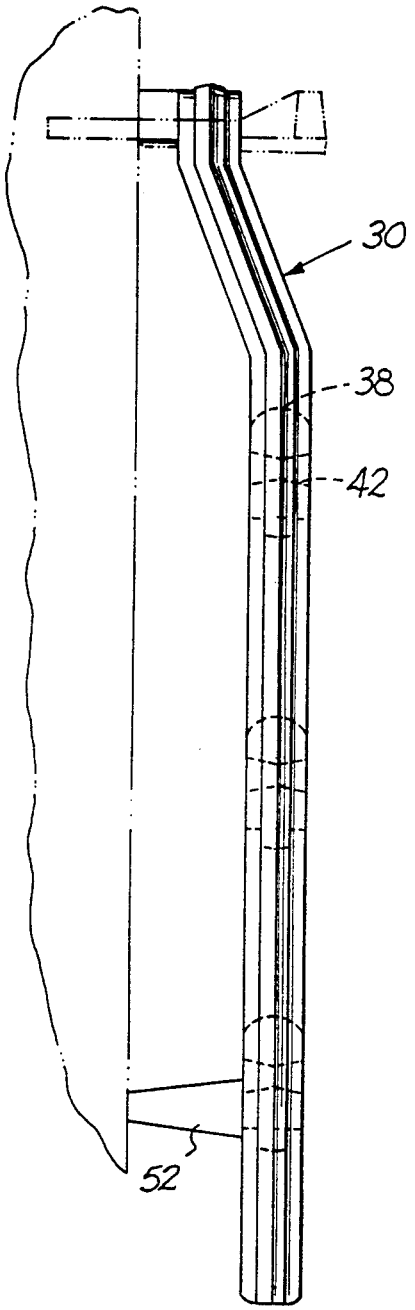
FIG. 3 is an enlarged side elevation view of the lower portion of one side of the manhole in FIG. 1 and the present ladder hanging from the side rails of the lowermost step which has previously been installed in the manhole wall.
Figure 2:
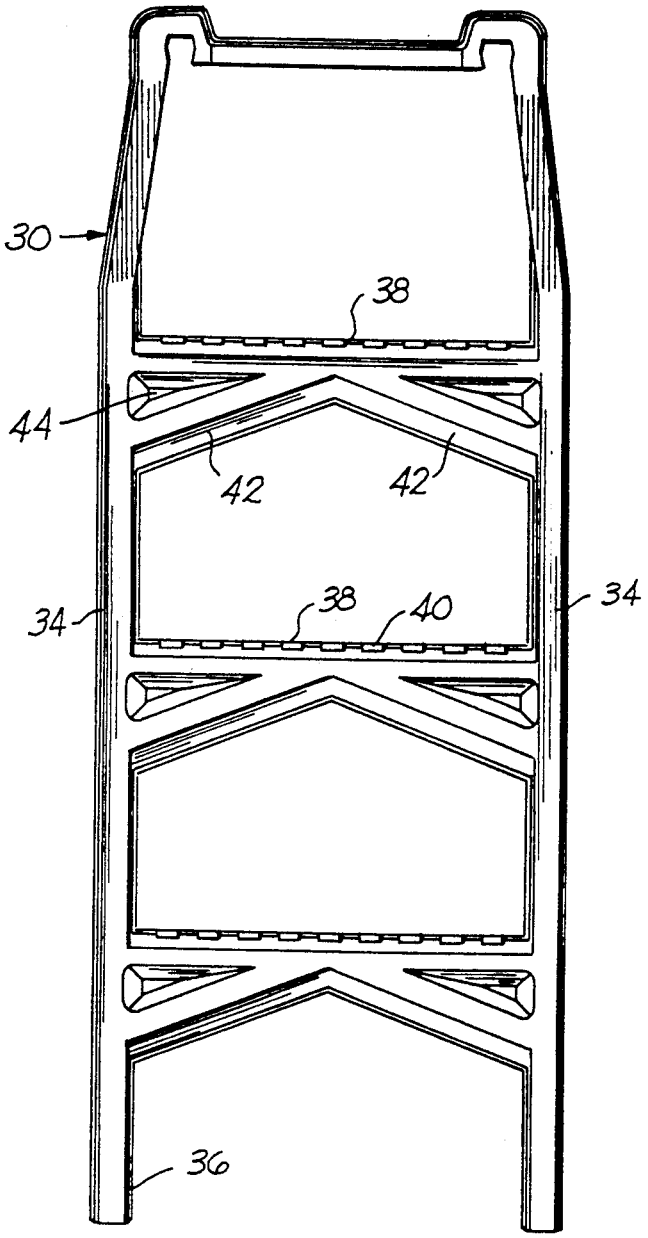
FIG. 2 is a front elevation view of the present ladder shown in FIG. 3 and without the manhole or step therein
Figure 6:
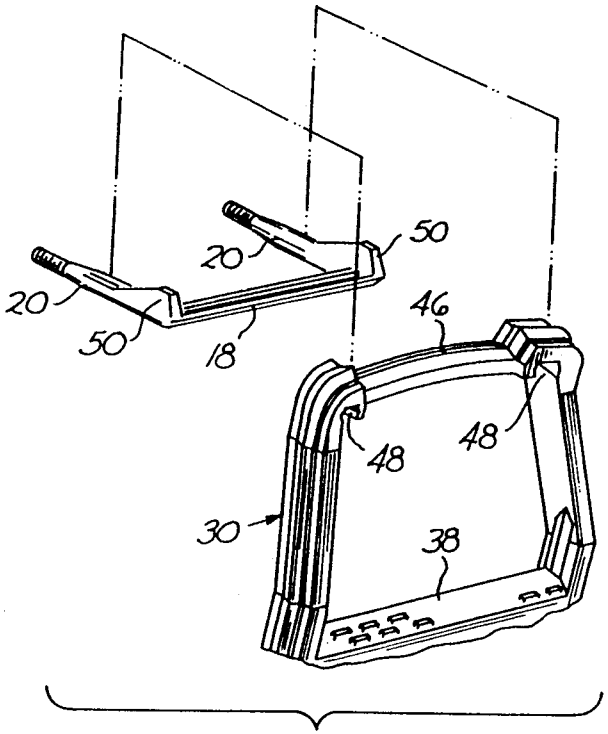
FIG. 6 is a disassembled assembly view similar to the one shown in FIG. 5, but looking from the opposite direction illustrating along with FIG. 5 bow the ladder is positioned or removed from the side rails of the lower most step.
Figure 5:
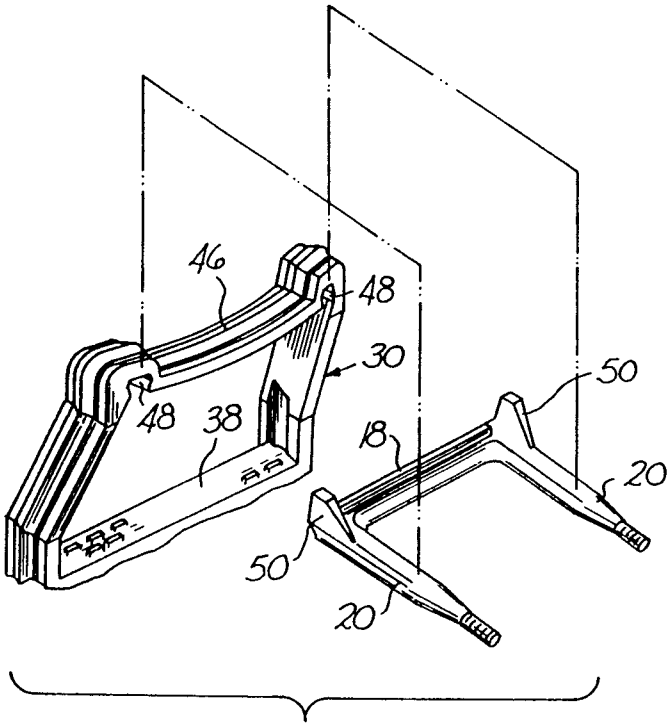
FIG. 5 is a disassembled assembly view of the top portion of the ladder in position for assembly on the lower most step in the manner shown in FIG. 3.
Figure 4:
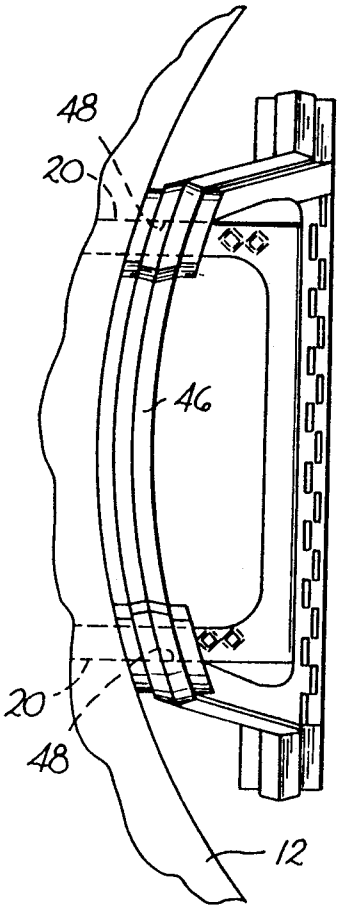
FIG. 4 is a top plan view taken along lines 4—4 in FIG. 1 and looking at the top of the installed ladder

Ladder 30 may be molded in one piece from high density polyethylene (HDPE) as stated previously and comprises side members 34 having bottom legs 36 thereon. Side members 34 are connected by integral spaced steps 38 which have treads 40 formed thereon. Each step 38, except for the first or top step, is braced by means of diagonal braces 42 extending from opposite side members 34 leaving a space 44 between the diagonal brace 42 and step 38. Top step 46 is a special curved construction as seen readily in FIG. 4 which bends around each side 34 to form a respective space at each inside corner having an optional groove 48 on each side of the ladder 30 which groove 48 is to be fitted over the complimentary shaped side leg members 20 on each side of the previously installed step 18 in the manner clearly shown in FIG. 3 and also in the disassembled assembly views of FIGS. 5 and 6. If the step 18 and side members 20 are of the molded type providing outstanding flanges 50 then the grooves 48 of the top of the ladder 30 may be placed over each respective flange 50 onto the side members 20 of each respective step 18 in the manner shown in FIGS. 1 and 3. A positioning member or bumper 52 is formed as part of the bottom of the ladder 30 to space the bottom of the ladder 30 from the inside wall of the manhole 10 and to position the ladder 30 in a substantially vertical position as shown in FIG. 1 and 3 so that the ladder 30 will not disengage from the bottom step 18 side members 20 during use. To facilitate this characteristic the respective side members 34 of the ladder 30 adjacent the top are bent and inclined from the remainder of the ladder 30 in the manner shown in FIGS. 1, 3, 4, 5 and 6.

While grooves 48 may be made complementary to the cross-section of step side leg members 20 so as to make a tight "snap" fit, any other configuration of either the leg members 20 or space at groove 48 may be used such as semi-circular or circular, with or without a close fit. Groove 48 can be such dimensions as to accommodate any shape or size of step side leg members 20.

While there is shown herein a particular ladder for purpose of illustration and disclosure of a preferred embodiment, this does not constitute any sort of limitation on the scope of this invention, since there are various alterations, deviations, eliminations, substitutions and departures which may be made in the disclosed embodiment without departing from the scope of this invention as defined only by a proper interpretation of the appended claims.

What is claimed is:

1. In a ladder which may be molded from plastic for use in a manhole in which permanent manhole steps are installed in spaced relation from the top of the manhole to a position above the bottom, the manhole steps having spaced step side members installed in the wall of the manhole:

a pair of spaced ladder side members on said ladder connected transversely by spaced ladder steps including a top step attached thereto, spaced corners at the top step of said ladder, and open spaces each including an open groove defined by the top step on each side of the ladder inside the side members at each of the top corners thereof and the grooves fitted onto a respective side member of a lower manhole step, thereby supporting the ladder in the manhole and increasing the size of the top step, the spaces at each top corner of said ladder having a respective open shape formed thereon and said open shape being complementary to a shape of a step side member to fit thereon.

2. The ladder claimed in claim 1 wherein said top portion of said ladder is inclined on the side members of said ladder.

3. The ladder claimed in claim 1 wherein each step of said ladder is braced by means of a diagonal brace extending beneath said step from said side member.

4. The ladder claimed in claim 1, wherein: said shape in said space being three dimensioned to fit tightly with said step side member.

5. The ladder in claim 4, wherein: the ladder has three-dimension groves in said spaces to receiver the respective step side members.

6. The ladder claimed in claim 1, wherein: said manhole step is provided with respective upstanding flanges on each side thereof adjacent the respective step side members for said ladder to be positioned over and inside said flanges and on said step side members.

7. The ladder claimed in claim 1, wherein: said spaces on said ladder and said manhole step side members have interlocking means there between.

* * * * *